US005713540A

United States Patent [19]

Gerszberg et al.

[11] Patent Number: 5,713,540

[45] Date of Patent: Feb. 3, 1998

[54] METHOD AND APPARATUS FOR DETECTING RAILWAY ACTIVITY

[75] Inventors: Irwin Gerszberg, South Brunswick; Thomas T. Shen, East Hanover, both of N.J.

[73] Assignee: AT&T Corp., Middletown, N.J.

[21] Appl. No.: 670,920

[22] Filed: Jun. 26, 1996

[51] Int. Cl.[6] ..... B61L 23/04

[52] U.S. Cl. ..... 246/121; 246/167 R; 73/587; 73/645

[58] Field of Search ..... 246/120, 121, 246/167 R; 73/587, 645, 646, 647, 648

[56] References Cited

U.S. PATENT DOCUMENTS

| | | | |
|---|---|---|---|
| 4,235,112 | 11/1980 | Kaiser | 73/634 |
| 4,578,665 | 3/1986 | Yang | 340/48 |
| 4,752,053 | 6/1988 | Boetzkes | 246/167 R |
| 5,289,183 | 2/1994 | Hassett et al. | 340/905 |
| 5,429,329 | 7/1995 | Wallace et al. | 246/121 |
| 5,445,347 | 8/1995 | Ng | 246/169 R |
| 5,529,267 | 6/1996 | Giras et al. | 246/121 |

*Primary Examiner*—S. Joseph Morano
*Attorney, Agent, or Firm*—Alfred G. Steinmetz

[57] ABSTRACT

A highly reliable early warning system that can provide efficient detection of railway activity and early warning of dangerous railway conditions to train operators and to central dispatch control offices. The warning system has an acoustic sensor circuit coupled to the railway for detecting sound waves resulting from physical vibrations thereon, an acoustic analyzer unit for analyzing the sound waves detected on the railway to identify any suspect conditions thereon and to generate an alarm if such a suspect condition is identified, and an acoustic signal processing unit for storing detected sound waves in a sound file for quick retrieval and analysis. The alarm signal may be transmitted over any communications system to the central control office and to trains traveling on the dangerous track. The stored sound files may be locally retrieved or downloaded to a remote location over a cellular system, thus enabling the analysis of the actual sound generated by the dangerous condition to determine the cause therefore.

32 Claims, 4 Drawing Sheets

METHOD AND APPARATUS FOR DETECTING RAILWAY ACTIVITY

FIELD OF THE INVENTION

This invention relates to warning systems, and more particularly to railway warning and alarm systems.

BACKGROUND OF THE INVENTION

Heretofore, railroad-crossing warning systems use pole lines connected to trackside devices to communicate vital train information to passing motorists and pedestrians. That is, present day railroad warning systems use pole lines to transmit a signal to a flashing light and a retractable gate to warn pedestrians and motorists that a train is approaching the railroad crossing.

In addition, present day railroad warning systems use trackside devices to communicate critical railway acoustic activity over the pole lines. The usefulness of pole lines to report such activity has become suspect, however, due to their high cost of construction and maintenance, disadvantageous effect on the surrounding community, and susceptibility to adverse weather conditions. Moreover, presently there are no warning systems that provide early detection of railway activity (e.g. vandalism and dangerous conditions), and provide early warning of that activity to trains traveling on the railway and to a central train dispatch office.

Some prior art systems use remote-controlled companion railway cars to explore the track immediately in from of the locomotive and immediately report back any vital alarm data to the locomotive via a private radio system. Such a system, however, does not provide a means for substantially identifying the actual problem that exists on the rail, nor does such a system provide early notice of such dangerous conditions (i.e. vandalism, fallen rocks, and defective rails) to a central train dispatch office monitoring the railway safety and railway traffic.

SUMMARY OF THE INVENTION

Accordingly, the present invention is directed to a highly reliable early warning system that can provide efficient detection of railway activity and early warning of suspicious conditions to both train operators and a central dispatch office. To attain this, the present invention provides a warning system having an acoustic sensor circuit coupled to the railway for detecting sound waves resulting from physical vibrations thereon, an acoustic analyzer unit for analyzing the sound waves detected on the railway to identify any suspect conditions thereon and to generate an alarm if such a suspect condition is identified, and an acoustic signal processing unit for storing detected sound waves in a sound file for quick retrieval and analysis.

In one embodiment of the invention, the acoustic sensor circuit has an acoustic sensor coupled to each rail of the railway through a sensing bar. The analyzer unit has a pair of filters coupled to the acoustic sensors, and a logic circuit coupled to the pair of filters. The acoustic signal processing unit has an analog to digital converter coupled to the acoustic sensors, and a digital signal processor coupled to the analog to digital converters and a controller having internal storage.

In such an embodiment, each acoustic sensor monitors its respective rail for sound waves and outputs an analog signal (i.e. V1 for rail 1 and V2 for rail 2) indicating the sound waves detected on thereon. The outputs V1 and V2 are then communicated to the logic circuit of the acoustic analyzer unit through filters, and to the acoustic signal processing unit. To determine if a dangerous condition exists on either rail or both, the logic circuit compares the detected, filtered signals V1 and V2 to a predetermined threshold $V_o$, and compares the absolute difference between signals V1 and V2 (i.e. $|V2-V1|$) to a predetermined threshold difference $X_o$. If either of these comparisons reveal a condition above the threshold $V_o$ and/or $X_o$, then the logic circuit generates an alarm signal. When such an alarm is detected, the acoustic signal processing unit converts the actual sound waves V1 and V2 into digital format and stores the digital information in a sound file for easy retrieval. As a result, suspect conditions on the rail can be detected at an early stage, and the actual sound waves that indicate a suspect condition can be retrieved, replayed and analyzed, thus providing early warning of and a means for identifying any dangerous conditions on the railway.

These and other features of the invention are described in more detail in the following detailed description of the embodiments of the invention when taken with the drawings. The scope of the invention, however, is limited only by the claims appended hereto.

DETAILED DESCRIPTION OF ILLUSTRATIVE EMBODIMENTS OF THE INVENTION

Figure 1:
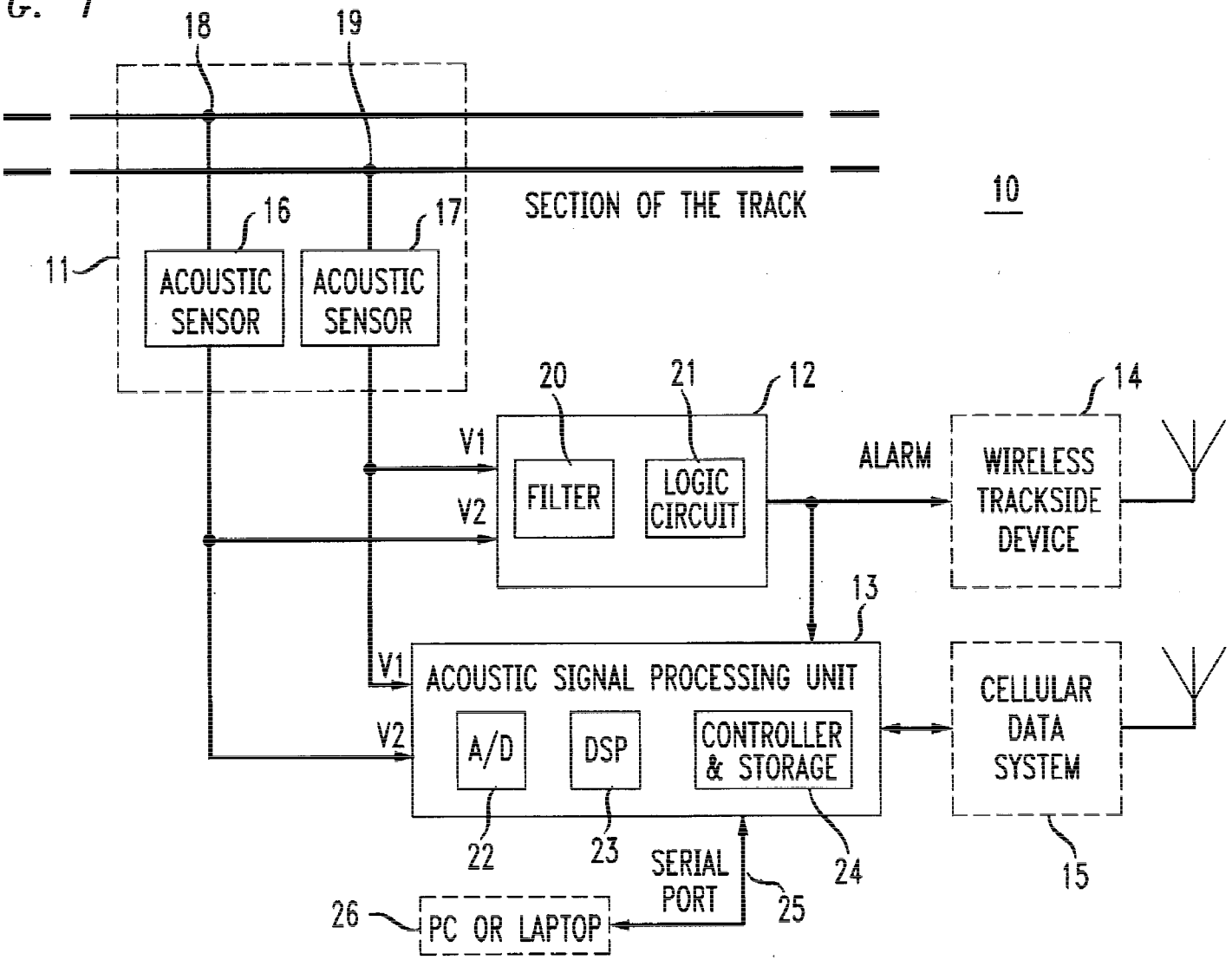
FIG. 1 is a block diagram of one embodiment of the railway warning system according to the present invention.

Referring now to FIG. 1, there is shown one embodiment of a warning system according to the present invention, hereinafter referred to as warning system 10. As shown, warning system 10 has an acoustic detector circuit 11, an acoustic analyzer 12, an acoustic signal processing unit 13, a wireless communications device 14, and a data communications device 15.

Acoustic detector circuit 11 has an acoustic sensor 16 coupled to one rail through a sensing bar 18, and an acoustic sensor 17 coupled to the other rail through a sensing bar 19. The outputs of acoustic sensors 16 and 17 are coupled to acoustic analyzer 12 and acoustic signal processing unit 13. Acoustic analyzer 12 has filters 20 and a logic circuit 21 which is coupled to wireless communications device 14. Acoustic signal processing unit 13 has an analog to digital (A/D) converter 22, a digital signal processor 23 and a controller 24 which is coupled to data communications device 15. In addition, acoustic signal processing unit 13 has a serial port 25 for connecting to an external data retrieval device 26.

In operation, acoustic sensors 16 and 17 detect sound waves on their respective rails through their respective sensing bars 18 and 19. That is, sensing bar 18 detects sound waves on its respective rail and outputs an analog signal V1, and sensing bar 19 detects sound waves on its respective rail and outputs and analog signal V2. Analog signals V1 and V2 are then sent through acoustic sensors 16 and 17, respectively, to acoustic signal analyzer 12 for possible alarm generation and to acoustic signal processing unit 13 for possible storage.

Upon reaching acoustic signal analyzer 12, signals V1 and V2 are each passed through filters 20 which pass only a range of frequencies to logic circuit 21. Logic circuit 21 detects for unbalanced sound wave signals between the rails and for high pitched sound waves indicating a problem or a possible dangerous condition exists on the railway. If such an unbalanced condition or a high pitched sound is detected, logic circuit 21 generates an alarm.

For example, logic circuit 21 can detect unbalanced rail activity by taking the absolute value of the difference between V1 and V2 (i.e. |V2−V1|) and compare that to some threshold or acceptable difference between the rails $X_o$. If the difference is greater than predetermined threshold difference $X_o$, then logic circuit 21 generates an alarm signal indicating a possible problem between the rails. Likewise, logic circuit 21 can detect whether a single rail has a possible dangerous condition by comparing the individual signals V1 and V2 to some threshold $V_o$. If the difference between V1 or V2 and $V_o$ is greater than zero, then logic circuit 21 generates an alarm signal indicating a possible problem with one or both of the rails.

Figure 2:
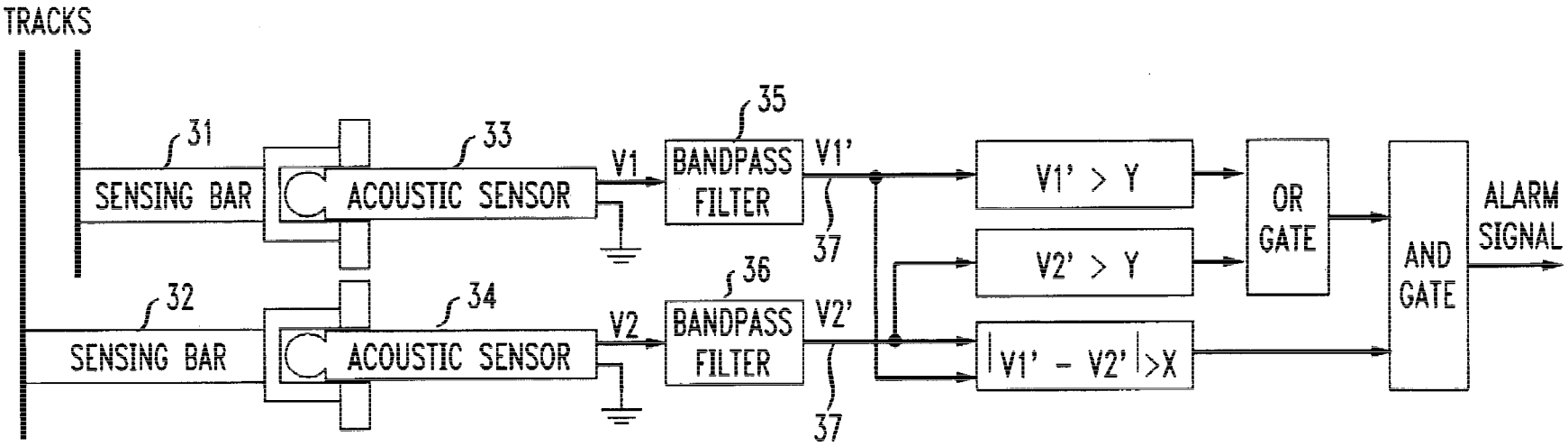
FIG. 2 is a pictorial view of a method for generating an alarm signal through the acoustic signal analyzer as shown in FIG. 1.

FIG. 2 shows a functional block diagram of one method of sensing acoustic soundwaves on the rail and generating an alarm signal if a problem is detected thereon. As shown, sensing bar 31 is coupled to one rail of the train track and sensing bar 32 is coupled to the other rail of the track. The acoustic waves V1 and V2 generated on the track by some activity (i.e. an approaching train or fallen rocks hitting the rail) are coupled to acoustic sensors 33 and 34, respectively, through sensing bars 31 and 32, respectively. The signals V1 and V2 are then sent through band pass filters 35 and 36, respectively, thus leaving filtered signals V1' and V2', respectively. Filtered signals V1' and V2' are then sent to logic circuit 37 which performs the signal analysis, as described above, to generate an alarm signal, if necessary.

The sensing bars 31 and 32 can be made of a small diameter steel material having a fixed length with a constant resonant frequency. Acoustic sensors may be a piezoelectric type sensitive directional microphone with a built-in low noise amplifier. Such directional microphones convert the detected sound pressure to the electrical signals V1 and V2, wherein the frequency response of the directional microphone may range from 30 Hz to 30 Khz. The dynamic sensitivity range of the microphones, however, should be very wide to insure proper detection for all possible acoustic sources.

To avoid interference with existing track circuit operation, the sensors 33 and 34 should be electrically isolated from the sensing bars 31 and 32. In addition, the acoustic sensors 33 and 34 and the sensing bars 31 and 32 should be fully encapsulated and molded for electrostatic protection. Moreover, bandpass filters 35 and 36 are chosen to only pass the band frequencies of interest for the railroad application.

Referring now back to FIG. 1, the alarm signal generated by logic circuit 21 is sent to wireless trackside device 14 which communicates on a wireless communications system. As a result, wireless trackside device 14 provides the means for transmitting the alarm signal over a wireless communications system to train operators and to central office dispatch/control centers for early warning of a possible dangerous condition on the track.

Figure 3:
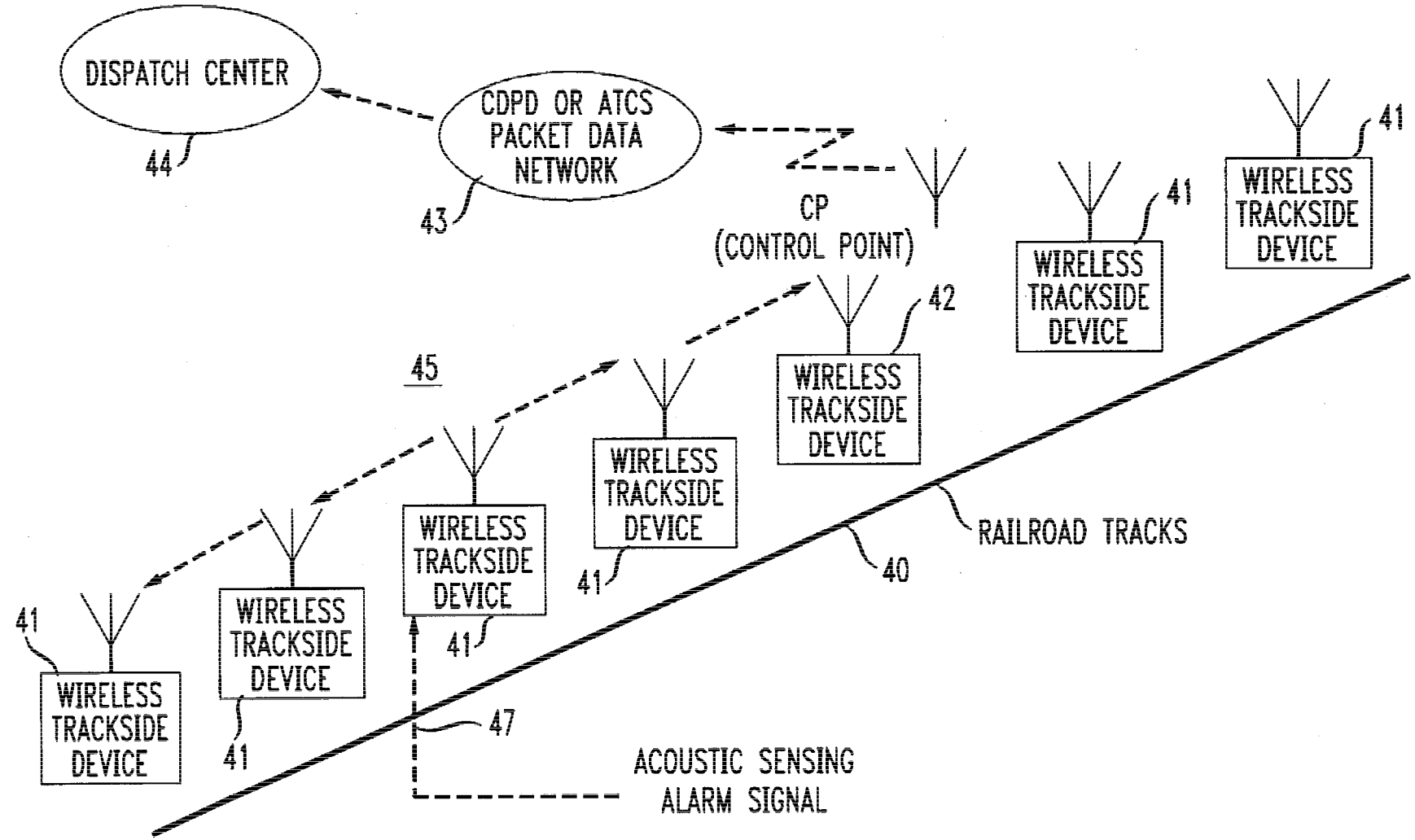
FIG. 3 is a pictorial view of one embodiment of a communications system for communicating the alarm signal shown in FIG. 2 to train operators and train dispatchers.

One embodiment of such a wireless communications system is shown in FIG. 3, hereinafter referred to as wireless communications system 45. As shown, wireless communications system 45 has a plurality of wireless trackside devices 41 positioned along railroad track 40. The alarm signal generated at location 47 is transmitted over wireless communications system 40 through wireless trackside devices 41 to control point 42, wherein the alarm signal is sent over a packet data network 43 to a central dispatch center 44. As a result, the communication of the alarm signal over wireless trackside devices 41 can be through any message-hopping method. As a result, after receiving the alarm signal, the wireless trackside devices 41 may broadcast both the alarm signal and an emergency message to warn train operators traveling on the railway upon which the dangerous condition was detected.

Figure 4:
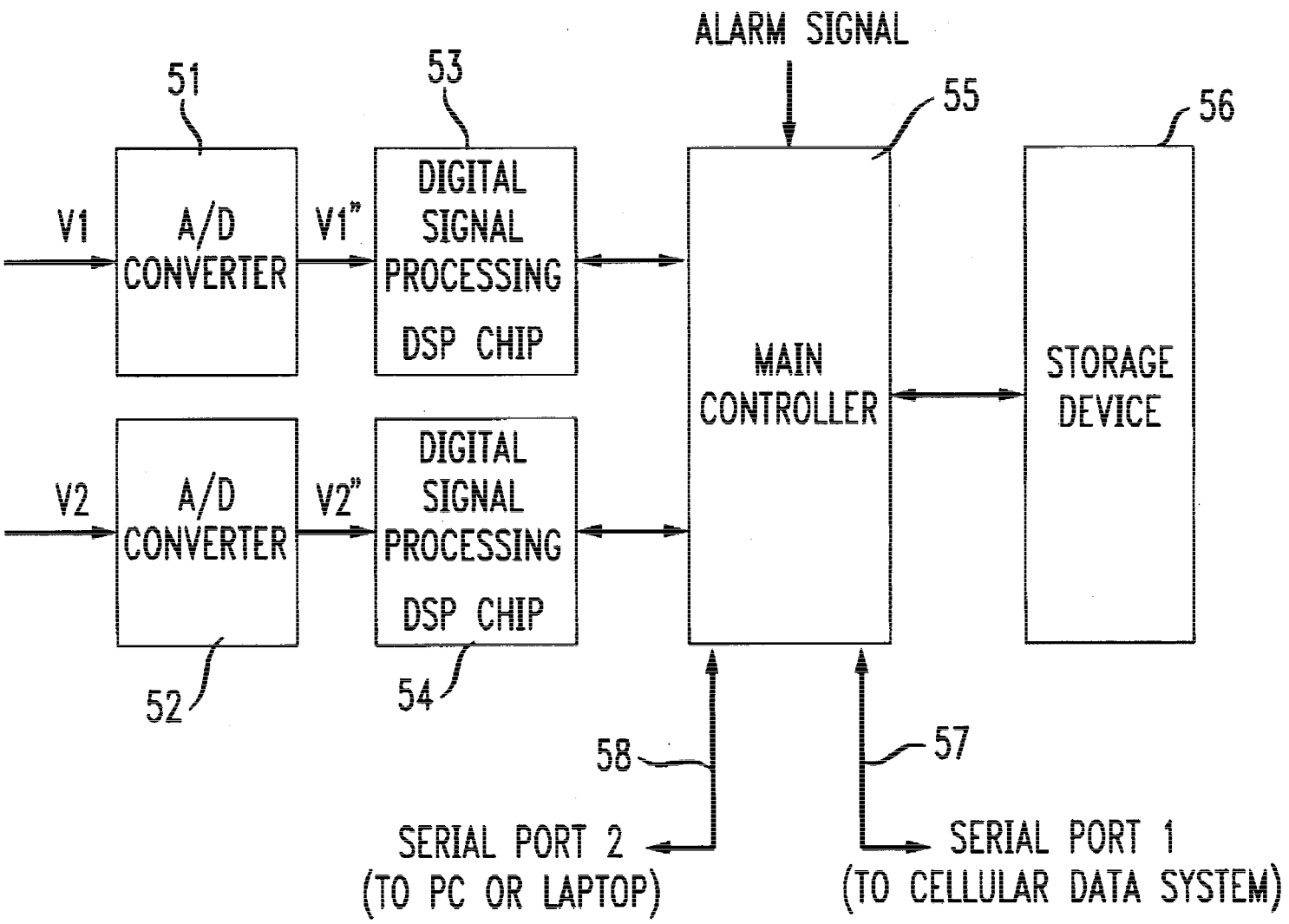
FIG. 4 is a diagrammatic view of a method for storing the detected sound waves through the acoustic signal processing unit shown in FIG. 1.

In addition to sending the detected signals V1 and V2 to acoustic analyzer 12, the detected signals V1 and V2 are also sent to acoustic signal processing unit 13, wherein the acoustic signals V1 and V2 are stored in a sound file for later retrieval. FIG. 4 shows a functional block diagram of one embodiment of the acoustic signal processing unit 13 shown in FIG. 1. As shown, detected analog signals V1 and V2 are input to A/D converters 51 and 52, respectively, thus outputting digital signals V1" and V2" to digital signal processors (DSP's) 53 and 54, respectively. DSP's 53 and 54 generally provide filtering, level detection, and sound waveform generation functions for the acoustic signal processing unit. In addition, DSP's 53 and 54 may also provide audio signature analysis for special function recognition, wherein the special functions include identifying the type of vandalism, the type and speed of a passing train, and track integrity monitoring.

The acoustic signal processing unit also has a main controller 55 which provides control and interface functions and a storage device 56 for storing the sound waves. As a result, DSP's 53 and 54 may send digital sound waveforms or signal V1" and V2", respectively, to main controller 55 for storage in storage device 56.

As shown in FIG. 1, the alarm signal generated by logic circuit 21 is also sent to acoustic signal processing unit 13. That is, in referring to FIG. 4, the alarm signal is sent to main controller 55. In addition, main controller 55 has two serial ports 57 and 58 which provide interfaces for remote download/alarm function (i.e. serial port 57) and local retrieval/maintenance function (i.e. serial port 58). As a result, a suspicious sound waveform file stored in storage device 56 may be downloaded to a dispatch center via a cellular data system, and may be retrieved locally via a personal computer (PC) or laptop computer through a sound card located therein.

Thus, the warning system of the present invention provides early warning of dangerous conditions on a railway to both a central dispatch control office and oncoming trains, and a means for retrieving and analyzing the actual sound waves generated by such dangerous conditions to identify the actual problem thereon.

The above description includes exemplary embodiments and methods of implementing the present invention. References to specific examples and embodiments in the description should not be construed to limit the present invention in any manner, and is merely provided for the purpose of describing the general principles of the present invention. It will be apparent to one of ordinary skill in the art that the present invention may be practiced through other embodiments.

What is claimed is:

1. A railway warning system for reporting activities and conditions, comprising:

an acoustic sensor circuit coupled to and in fixed stationary relation to a railway for passively detecting sound waves resulting from physical vibrations thereon occurring on the railway due to a disturbance located away from the sensor;

an acoustic analyzer unit coupled to said acoustic sensor circuit for analyzing said detected sound waves to identify the activities on and conditions of the railway, and for generating an alarm indicating a hazardous condition on the railway.

2. The warning system of claim 1 further comprising an acoustic signal processing unit coupled to said acoustic sensor circuit for storing said detected sound waves in a sound file.

3. The warning system of claim 2 wherein said acoustic sensor circuit comprises at least one acoustic sensor coupled to each rail of the railway.

4. The warning system of claim 3 wherein said acoustic analyzer unit comprises at least one acoustic filter for filtering said detected sound waves, and a logic circuit for analyzing said filtered detected sound waves and for generating said alarm if said sound waves meet a predetermined suspicious condition.

5. The warning system of claim 4 further comprising a means for communicating said alarm to said acoustic signal processing unit.

6. The warning system of claim 5 further comprising an alarm communications system for reporting said alarm generated by said acoustic analyzer to a central monitoring station.

7. The warning system of claim 6 wherein said alarm communications system is a wireless communications system.

8. The warning system of claim 7 wherein said wireless communications system is a packet data wireless system, wherein said packet data is communicated over a plurality of trackside communications devices.

9. The warning system of claim 8 wherein said wireless communications system reports said alarm to a locomotive traveling on the railway.

10. The warning system of claim 9 wherein said acoustic signal processing unit comprises an analog to digital converter for converting said detected sound waves from analog to digital, a digital signal processor for formatting said digital detected sound waves in a sound file format, and a processor having a storage medium for storing said sound file formatted digital detected sound waves.

11. The warning system of claim 10 further comprising a cellular data system for communicating said sound files to said central monitoring system.

12. The warning system of claim 11 further comprising a local retrieval device for retrieving said detected sound waves stored in said sound file format.

13. A method for reporting suspicious conditions on a railway, comprising the steps of:

a. monitoring the railway to detect sound waves resulting from physical vibrations thereon occurring on the railway due to a disturbance located away from a sensor of the sound waves;

b. analyzing said detected sound waves to identify a detected condition on the railway;

c. generating an alarm if said detected condition indicates a predetermined suspicious condition on the railway; and d. processing said detected sound waves having a said detected condition indicating a predetermined suspicious condition to store said detected sound waves in a sound file.

14. The method of claim 13 wherein said monitoring step a is performed through an acoustic sensor circuit having at least one acoustic sensor coupled to each rail of said railway.

15. The method of claim 14 wherein one said acoustic sensor coupled to one rail of said railway outputs a first analog signal V1 indicating the sound waves detected thereon, and wherein another said acoustic sensor coupled to another rail of said railway outputs a second analog signal V2 indicating the sound waves detected thereon.

16. The method of claim 15 wherein said analyzing step b is performed through an acoustic analyzer unit having at least one filter for filtering said first analog signal V1 and said second analog signal V2, and a logic circuit for detecting whether said filtered signals V1 and V2 indicate a given suspicious condition on said railway.

17. The method of claim 16 wherein said step of determining whether filtered signals V1 and V2 indicate a given suspicious condition on the railway, comprises the following steps:

taking the absolute value of the difference between V1 and V2 to determine a differential X;

comparing differential X to some minimum threshold differential $X_o$ to determine if a given suspicious condition exists on said railway;

comparing signal V1 to a minimum threshold $V_o$ to determine whether said rail from which V1 is derived has a suspicious condition thereon; and comparing signal V2 to a minimum threshold $V_o$ to determine whether said rail from which V2 is derived has a suspicious condition thereon.

18. The method of claim 17 wherein said step of processing said detected sound waves is performed through an acoustic signal processing unit having an analog to digital converter for converting said sound waves from analog to digital, a digital signal processor for formatting said digital detected sound waves in sound file format, and a processor having a storage medium for storing said sound file formatted detected sound waves.

19. The method of claim 18 further comprising the step of communicating said alarm signal to said acoustic signal processing unit.

20. The method of claim 19 further comprising the step of reporting said alarm generated by said acoustic analyzer to a central monitoring station through an alarm communications system.

21. The method of claim 20 wherein said alarm communications system is a wireless communications system.

22. The method of claim 12 wherein said wireless communications system is a packet data wireless system, wherein said packet data is communicated over a plurality of trackside communications devices.

23. The method of claim 22 wherein said wireless communication system reports said alarm to a locomotive traveling on said railway.

24. The method of claim 23 further comprising the step of retrieving said stored sound file into a local retrieval device.

25. The method of claim 24 wherein said local retrieval device is a lap top computer.

26. The method of claim 25 wherein said local retrieval device is a personal computer.

27. The method of claim 23 comprising the step of communicating said detected sound waves over a cellular data system.

28. The method of claim 27 wherein said acoustic communications system is a satellite data system.

29. A method for reporting suspicious conditions on a railway, comprising the steps of:

a. monitoring the railway to detect sound waves resulting from physical vibrations thereon the monitoring being performed through an acoustic sensor circuit having at least one acoustic sensor coupled to each rail of said railway, wherein one said acoustic sensor being coupled to one rail of said railway outputs a first analog signal V1 indicating sound waves detected thereon, and wherein another said acoustic sensor coupled to another rail of said railway outputs a second analog signal V2 indicating the sound waves detected therein;

b. analyzing said detected sound waves to identify a detected condition on the railway, said analyzing being performed through an acoustic analyzer unit having at least one filter for filtering said first analog signal V1 and said second analog signal V2, and a logic circuit for detecting whether said filtered signals V1 and V2 indicate a suspicious condition on said railway; determining whether filtered signals V1 and V2 indicate a given suspicious condition on the railway, including steps of;

taking the absolute value of the difference between V1 and V2 to determine a differential X;

comparing differential X to some minimum differential threshold $X_o$ to determine if a given suspicious condition exists on said railway;

comparing signal V1 to a minimum threshold $V_o$ to determine whether said rail from which V1 is derived has a suspicious condition thereon; and comparing signal V2 to a minimum threshold $V_o$ to determine whether said rail from which V2 is derived has a suspicious condition thereon; and c. generating an alarm if said detected condition indicates a predetermined suspicious condition on the railway; and d. processing said detected sound waves having a said detected condition indicating a predetermined suspicious condition to store said detected sound waves in a sound file.

30. A warning system for reporting activities on conditions of a railway, comprising:

an acoustic sensor circuit coupled to the railway for detecting sound waves resulting from physical vibrations thereon;

the acoustic sensor circuit comprising at least one acoustic sensor coupled to each rail of the railway;

an acoustic signal processing unit coupled to said acoustic sensor circuit for storing said detected sound waves in a sound file;

an acoustic analyzer unit coupled to said acoustic sensor circuit for analyzing said detected sound waves to identify the activities on and conditions of the railway, and for generating an alarm indicating a hazardous condition on the railway;

said acoustic analyzer unit comprising at least one acoustic filter for filtering said detected sound waves, and a logic circuit for analyzing said filtered detected sound waves and for generating said alarm if said sound waves meet a predetermined suspicious condition;

means for communicating said alarm to said acoustic processing unit;

an alarm communications system for reporting said alarm generated by said acoustic analyzer to a central monitoring station;

said alarm communications system being a wireless communication system; comprising in turn a packet data wireless system, wherein said packet data is communicated over a plurality of trackside communications devices; with the wireless communication system reporting said alarm to a locomotive traveling on the railway;

said acoustic signal processing unit comprising an analog-to-digital converter for converting said detected sound waves from analog to digital, a digital signal processor for formatting said digital sound waves in a sound file format, and a processor having a storage medium for storing said sound file formatted digital detected sound waves;

a cellular communications system for communicating signals representing said detected sound waves to said central monitoring station and a local retrieval device for retrieving said detected sound waves stored in said sound file format.

31. The warning system of claim 30 wherein said local retrieval device is a personal computer.

32. The warning system of claim 31 wherein said local retrieval device is a laptop computer.

* * * * *